US012672729B2

(12) United States Patent
Wei

(10) Patent No.: US 12,672,729 B2
(45) Date of Patent: Jul. 7, 2026

(54) DUVET COVER AND DUVET ASSEMBLY

(71) Applicant: Jiangsu E-Best Textile Technology Co., Ltd., Nantong City (CN)

(72) Inventor: Yang Wei, Nantong City (CN)

(73) Assignee: Jiangsu E-Best Textile Technology Co., Ltd., Nantong City (CN)

( * ) Notice: Subject to any disclaimer, the term of this patent is extended or adjusted under 35 U.S.C. 154(b) by 0 days.

(21) Appl. No.: 19/401,496

(22) Filed: Nov. 26, 2025

(65) Prior Publication Data

US 2026/0150988 A1 Jun. 4, 2026

(30) Foreign Application Priority Data

Nov. 29, 2024 (CN) ..... 202422946853.6

(51) Int. Cl.
*A47G 9/02* (2006.01)

(52) U.S. Cl.
CPC ..... *A47G 9/0261* (2013.01)

(58) Field of Classification Search
CPC ..... A47G 9/02; A47G 9/0207; A47G 9/0215; A47G 9/0223; A47G 9/023; A47G 9/0238; A47G 9/0261; A47G 2009/0269; A47G 2009/0276
See application file for complete search history.

(56) References Cited

U.S. PATENT DOCUMENTS 6,032,308 A * 3/2000 Chuang ..... A47G 9/0261 5/413 AM
6,363,553 B1 * 4/2002 Baumgartel ..... A47G 9/0253 5/699
8,458,832 B1 * 6/2013 Krishna ..... A47G 9/0261 5/501
10,582,783 B1 * 3/2020 Hill ..... A47G 9/04
10,918,230 B1 * 2/2021 Dompierre ..... A47C 31/10
2003/0135924 A1 * 7/2003 Chuang ..... A47G 9/0261 5/413 R
2004/0187210 A1 * 9/2004 Hickman ..... A47G 9/0253 5/482
2008/0222808 A1 * 9/2008 Bell ..... A47C 31/007 5/500
2009/0044337 A1 * 2/2009 McKee ..... A47G 9/02 5/496

(Continued)

FOREIGN PATENT DOCUMENTS

CN 215777018 U 2/2022

*Primary Examiner* — George Sun
(74) *Attorney, Agent, or Firm* — Cooper Legal Group, LLC

(57) ABSTRACT

A duvet cover and a duvet assembly. The duvet cover includes: a zipper and a cover body. The zipper includes a lower zipper chain, an upper zipper chain, and a slider. The cover body includes a lower cover piece and an upper cover piece. The lower cover piece includes a lower accommodation zone and a lower flange, where the lower zipper chain is stitched between the lower accommodation zone and the lower flange. The upper cover piece includes an upper accommodation zone and an upper flange, where the upper zipper chain is stitched between the upper accommodation zone and the upper flange. The upper zipper chain is located on an inner side of the lower zipper chain with their teeth facing each other, and the upper zipper chain, the lower zipper chain, the lower flange, and the lower accommodation zone are arranged side by side.

12 Claims, 7 Drawing Sheets

(56) References Cited

U.S. PATENT DOCUMENTS

| | | | | |
|---|---|---|---|---|
| 2010/0107339 | A1* | 5/2010 | Stinchcomb | A47G 9/02 5/502 |
| 2011/0041247 | A1* | 2/2011 | Moon | A47G 9/02 5/490 |
| 2016/0286988 | A1* | 10/2016 | Robert | A47G 9/02 |
| 2020/0260885 | A1* | 8/2020 | Stewart | A47G 9/0261 |

* cited by examiner

DUVET COVER AND DUVET ASSEMBLY

CROSS-REFERENCE TO RELATED APPLICATIONS

The present application claims priority of Chinese Patent Application No. 202422946853.6, filed on Nov. 29, 2024, in the China National Intellectual Property Administration, the entire contents of which are hereby incorporated by reference in its entirety.

TECHNICAL FIELD

The present disclosure relates to the technical field of bedding products, and in particular, to a duvet cover and a duvet assembly.

BACKGROUND

A duvet assembly typically includes a duvet cover and a duvet insert. The duvet insert is usually filled with materials such as cotton wadding or down, which are inconvenient to clean. Therefore, the duvet cover is sleeved over the duvet insert, enclosing it within an accommodation cavity of the cover to prevent soiling. When cleaning is required, it is only required to remove the duvet insert from the cavity and then clean the duvet cover. In the related art, a traditional duvet cover is made by sewing three sides of an upper piece and a lower piece together, leaving one side with an opening for inserting and removing the duvet insert. However, due to the small size of this opening, it is inconvenient for both insertion and removal of the duvet insert. To address this drawback, a design was developed where one side of the upper and lower pieces is sewn together, with openings provided on the other three sides, each arranged with a zipper. This enlarges the accessible opening area, facilitating easier insertion and removal of the duvet insert. However, in existing designs, the upper and lower zipper chains of the zipper are sewn onto the upper and lower surfaces of the cover respectively; and the zipper often forms an angle (typically a right angle) with these surfaces. Consequently, when operating the zipper to open or close the cover, the duvet insert or the upper and lower pieces of the cover can easily collapse and get caught in the zipper teeth, causing the zipper slider to jam when pulled.

The above content is intended merely to assist in understanding the technical solution of the present disclosure and does not constitute an admission that said content is prior art.

SUMMARY OF THE DISCLOSURE

The present disclosure provides a duvet cover, including:

a zipper; wherein the zipper includes at least one lower zipper chain and at least one upper zipper chain that cooperate with each other, and a slider that slidably cooperates with the at least one lower zipper chain and the at least one upper zipper chain; and a cover body; including a lower cover piece and an upper cover piece; wherein the lower cover piece includes a lower accommodation zone located in a central part of the lower cover piece and a lower flange connected to an outer edge of the lower accommodation zone; the at least one lower zipper chain is stitched between the lower accommodation zone and the lower flange; the upper cover piece includes an upper accommodation zone located in a central part of the upper cover piece and an upper flange connected to an edge of the upper accommodation zone; the at least one upper zipper chain is stitched between the upper accommodation zone and the upper flange; the upper accommodation zone and the lower accommodation zone are opposite to each other and enclosing to define a duvet insert accommodation cavity;

wherein the at least one upper zipper chain is located on an inner side of the at least one lower zipper chain, with teeth of the at least one upper zipper chain and teeth of the at least one lower zipper chain facing each other; the at least one upper zipper chain, the at least one lower zipper chain, the lower flange, and the lower accommodation zone are arranged side by side.

In some embodiments, the at least one lower zipper chain is at least two lower zipper chains arranged at an angle to each other, and the at least one upper zipper chain is at least two upper zipper chains arranged at an angle to each other; the zipper further includes a lower transition portion and an upper transition portion; the lower transition portion connects adjacent two lower zipper chains of the at least two lower zipper chains, and the upper transition portion connects adjacent two upper zipper chains of the at least two upper zipper chains;

teeth of the upper transition portion and the lower transition portion face each other, and a side-by-side direction of the upper transition portion and the lower transition portion is arranged at an angle to the lower flange.

In some embodiments, the upper transition portion includes an upper corner segment and two upper transition segments; the two upper transition segments smoothly connect two ends of the upper corner segment to the adjacent two upper zipper chains, respectively;

the lower transition portion includes a lower corner segment and two lower transition segments; the two lower transition segments smoothly connect two ends of the lower corner segment to the adjacent two lower zipper chains, respectively;

the lower corner segment and the upper corner segment are aligned in a covering direction of the lower cover piece and the upper cover piece.

In some embodiments, the duvet cover further includes at least one tie strap; wherein each tie strap is fixedly stitched at a connection between the lower flange and the lower accommodation zone and located within the duvet insert accommodation cavity.

In some embodiments, each lower corner segment is arranged with a corresponding tie strap.

In some embodiments, a side edge of the lower cover piece is stitched to a side edge of the upper cover piece, other three side edges of the lower cover piece are each arranged with a corresponding lower zipper chain, and other three side edges of the upper cover piece are each arranged with a corresponding upper zipper chain.

In some embodiments, an edge of the lower cover piece is folded back towards an edge of the lower accommodation zone to overlap and form the lower flange, and the lower zipper chain is stitched between two opposing fabric surfaces of the lower flange.

In some embodiments, an edge of the upper cover piece is folded back towards an edge of the upper accommodation zone to overlap and form the upper flange, and the upper zipper chain is stitched onto a fabric surface of the upper flange facing the lower cover piece.

In some embodiments, a distance between teeth of each lower zipper chain and a stitching line when the lower zipper chain is stitched to the lower flange is greater than a distance between teeth of each upper zipper chain and a stitching line when the upper zipper chain is stitched to the upper flange.

The present disclosure further provides a duvet assembly. The duvet assembly includes a duvet insert and a duvet cover. The duvet cover is the duvet cover described above, and the duvet insert is placed within the duvet insert accommodation cavity of the duvet cover.

BRIEF DESCRIPTION OF THE DRAWINGS

To explain the technical solutions in the embodiments of the present disclosure more clearly, the following will briefly introduce the drawings needed for describing the embodiments. Obviously, the drawings in the following description are only some embodiments of the present disclosure. For those skilled in the art, other drawings may be obtained based on these drawings without creative effort.

REFERENCE NUMERALS

Figure 1:
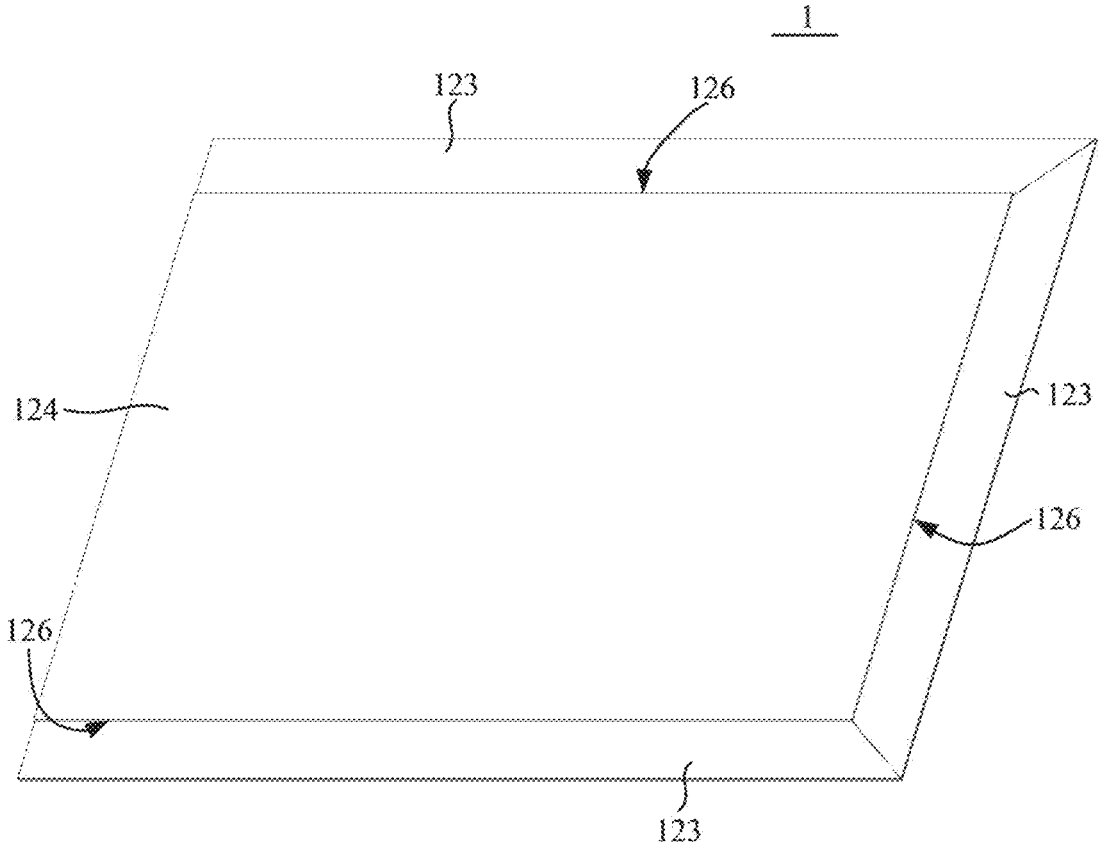
FIG. 1 is a structural schematic view of a duvet cover according to some embodiments of the present disclosure.

| Numeral | Name | Numeral | Name | Numeral | Name |
|---|---|---|---|---|---|
| 1 | Duvet Cover | 100 | Zipper | 110 | Lower Zipper Chain |
| 111 | Upper Zipper Chain | 112 | Slider | 113 | Upper Transition Portion |
| 114 | Upper Corner Segment | 115 | Upper Transition Segment | 116 | Lower Transition portion |
| 117 | Lower Corner Segment | 118 | Lower Transition Segment | 120 | Cover Body |
| 121 | Lower Cover Piece | 122 | Lower Accommodation Zone | 123 | Lower Flange |
| 124 | Upper Cover Piece | 125 | Upper Accommodation Zone | 126 | Upper Flange |
| 130 | Duvet Insert Accommodation Cavity | 140 | Tie Strap | 141 | Male Buckle |
| 142 | Female Buckle | 150 | Stitching Line | | |

The realization of the objectives, functional features, and advantages of the present disclosure will be further explained in combination with the embodiments and with reference to the drawings.

DETAILED DESCRIPTION

The technical solutions in the embodiments of the present disclosure will be clearly and completely described below with reference to the drawings in the embodiments of the present disclosure. Obviously; the described embodiments are only a part of the embodiments of the present disclosure, not all of them. Based on the embodiments in the present disclosure, all other embodiments obtained by those skilled in the art without creative work shall fall within the scope of the present disclosure. In addition, the technical solutions of the various embodiments may be combined with each other, but it must be based on the ability of those skilled in the art to realize it. When the combination of technical solutions results in mutual contradiction or cannot be realized, it should be considered that such a combination of technical solutions does not exist and is not within the claimed protection scope of the present disclosure.

It should be noted that when there are directional indications (such as up, down, left, right, front, back . . . ) involved in the embodiments of the present disclosure, these directional indications are only used to explain the relative positional relationship, movement, etc., between the various components under a specific posture. When this specific posture changes, the directional indication will change accordingly.

In addition, when there are descriptions involving "first", "second", etc., in the embodiments of the present disclosure, these descriptions are for descriptive purposes only and cannot be understood as indicating or implying relative importance or implicitly specifying the quantity of the indicated technical features. Thus, features defined by "first", "second" may explicitly or implicitly include at least one such feature. In addition, the meaning of "and/or" appearing in the full text includes three parallel schemes. Taking "A and/or B" as an example, it includes scheme A, or scheme B, or the scheme where both A and B are satisfied.

The present disclosure proposes a duvet cover 1. Referring to FIGS. 1 to 9, the duvet cover 1 includes:

a zipper 100, including a lower zipper chain 110 and an upper zipper chain 111 that cooperate with each other, and a slider 112 that slidably cooperates with the lower zipper chain 110 and the upper zipper chain 111; and a cover body 120, including a lower cover piece 121 and an upper cover piece 124; where the lower cover piece 121 includes a lower accommodation zone 122 located in a central part of the lower cover piece 121 and a lower flange 123 connected to an outer edge of the lower accommodation zone 122; the lower zipper chain 110 is stitched between the lower accommodation zone 122 and the lower flange 123; the upper cover piece 124 includes an upper accommodation zone 125 located in a central part of the upper cover piece 124 and an upper flange 126 connected to an edge of the upper accommodation zone 125; the upper zipper chain 111 is stitched between the upper accommodation zone 125 and the upper flange 126; the upper accommodation zone 125 and the lower accommodation zone 122 are opposite to each other and enclose to define a duvet insert accommodation cavity 130;

where the upper zipper chain 111 is located on an inner side of the lower zipper chain 110, with teeth of the upper zipper chain 111 and teeth of the lower zipper chain 110 facing each other; the upper zipper chain 111, the lower zipper chain 110, the lower flange 123, and the lower accommodation zone 122 are arranged side by side.

In the embodiments of the present disclosure, the duvet cover 1 includes a zipper 100 and a cover body 120. The zipper 100 includes a lower zipper chain 110 and an upper zipper chain 111 that cooperate with each other, and a slider 112 that slidably cooperates between them. The slider 112 is configured to control the opening and closing between the lower and upper zipper chains when it slides on them. It should be noted that the lower zipper chain 110 and upper zipper chain 111 each includes a tape and multiple teeth arranged on a side of the tape. The cover body 120 includes a lower cover piece 121 and an upper cover piece 124. The lower cover piece 121 includes a lower accommodation zone 122 in its central part and a lower flange 123 connected to the outer edge of the lower accommodation zone 122. The lower zipper chain 110 is stitched between the lower accommodation zone 122 and the lower flange 123. In the embodiments, the lower accommodation zone 122 is an area accommodating part of the duvet insert, and the lower flange 123 is a part protruding from the lower accommodation zone 122. The upper cover piece 124 includes an upper accommodation zone 125 in its central part and an upper flange 126 connected to the edge of the upper accommodation zone 125. The upper zipper chain 111 of the zipper 100 is stitched between the upper accommodation zone 125 and the upper flange 126. It should be noted that when the lower zipper chain 110 is stitched between the lower accommodation zone 122 and the lower flange 123, it is done by stitching the tape of the upper zipper chain 111 between the lower accommodation zone 122 and the lower flange 123. The upper accommodation zone 125 is an area accommodating part of the duvet insert, and the upper flange 126 is a part protruding from the upper accommodation zone 125. When the upper zipper chain 111 is stitched between the upper accommodation zone 125 and the upper flange 126, it is done by stitching the tape of the lower zipper chain 110 between the upper accommodation zone 125 and the upper flange 126. Furthermore, when the upper cover piece 124 covers the lower cover piece 121, the upper accommodation zone 125 and the lower accommodation zone 122 are opposite each other and enclose to define a duvet insert accommodation cavity 130, and the entire duvet insert is accommodated within the duvet insert accommodation cavity 130. The upper zipper chain 111 is located on the inner side of the lower zipper chain 110, and the teeth of the upper and lower zipper chains face each other. The upper zipper chain 111, the lower zipper chain 110, the lower flange 123, and the lower accommodation zone 122 are arranged side by side. Specifically; when the duvet cover 1 is spread flat on the bed, the upper zipper chain 111 is on the inner side of the lower zipper chain 110, meaning their positional relationship is inner/outer. The teeth of the upper zipper chain 111 face outward, and the teeth of the lower zipper chain 110 face inward. Simultaneously; the upper zipper chain 111, the lower zipper chain 110, the lower flange 123, and the lower accommodation zone 122 are arranged side by side along the extension direction of the bed surface.

It should be noted that the shape of the cover body 120 varies. For case of understanding, the embodiments use a conventional rectangular duvet cover 1 for illustration. This description is merely an example for understanding and is not limiting. That is, the duvet cover 1 is quadrilateral, and the upper zipper chain 111 and lower zipper chain 110 may be arranged on any one side, multiple sides, or all four sides of the quadrilateral upper cover piece 124 and lower cover piece 121, respectively.

Figure 3:
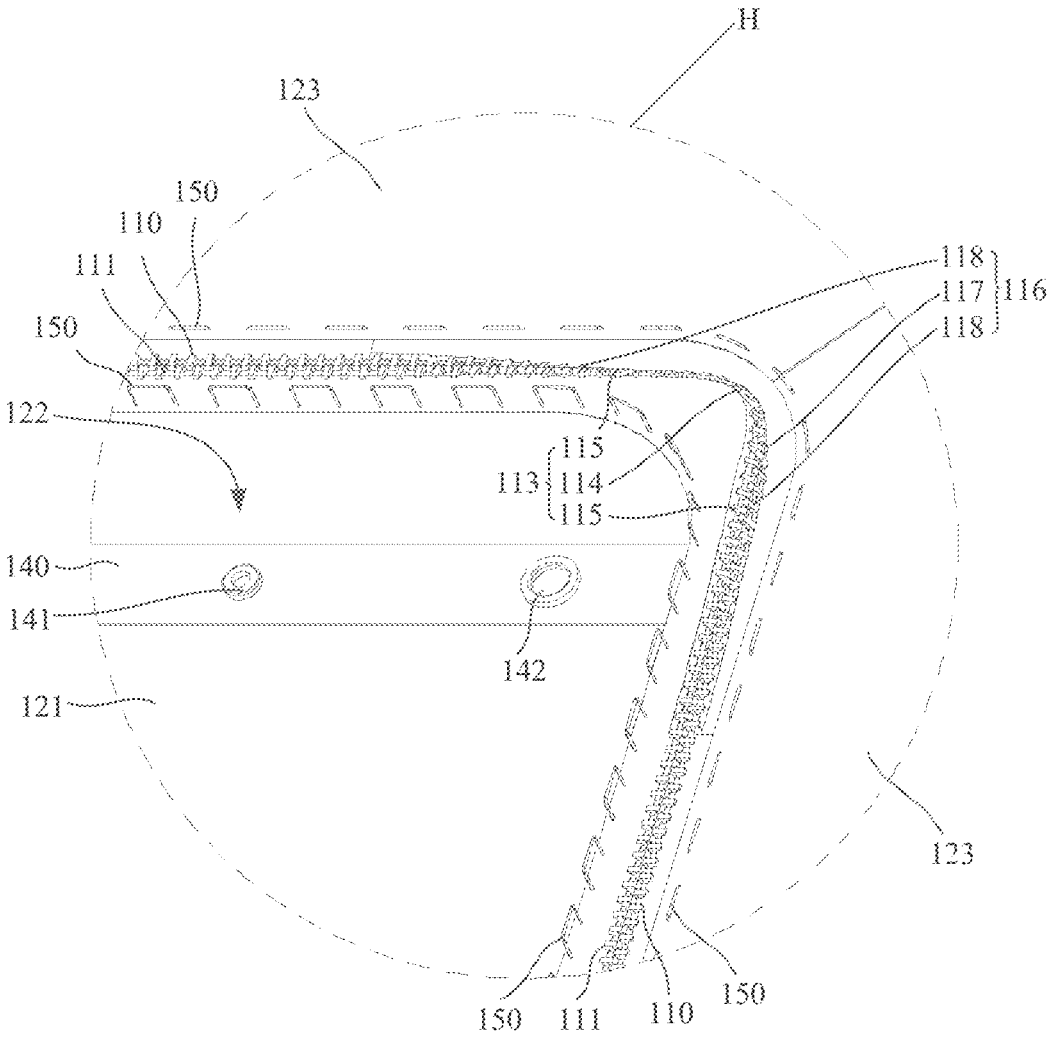
FIG. 3 is a partial enlarged view of portion H circumscribed in FIG. 2.
Figure 4:
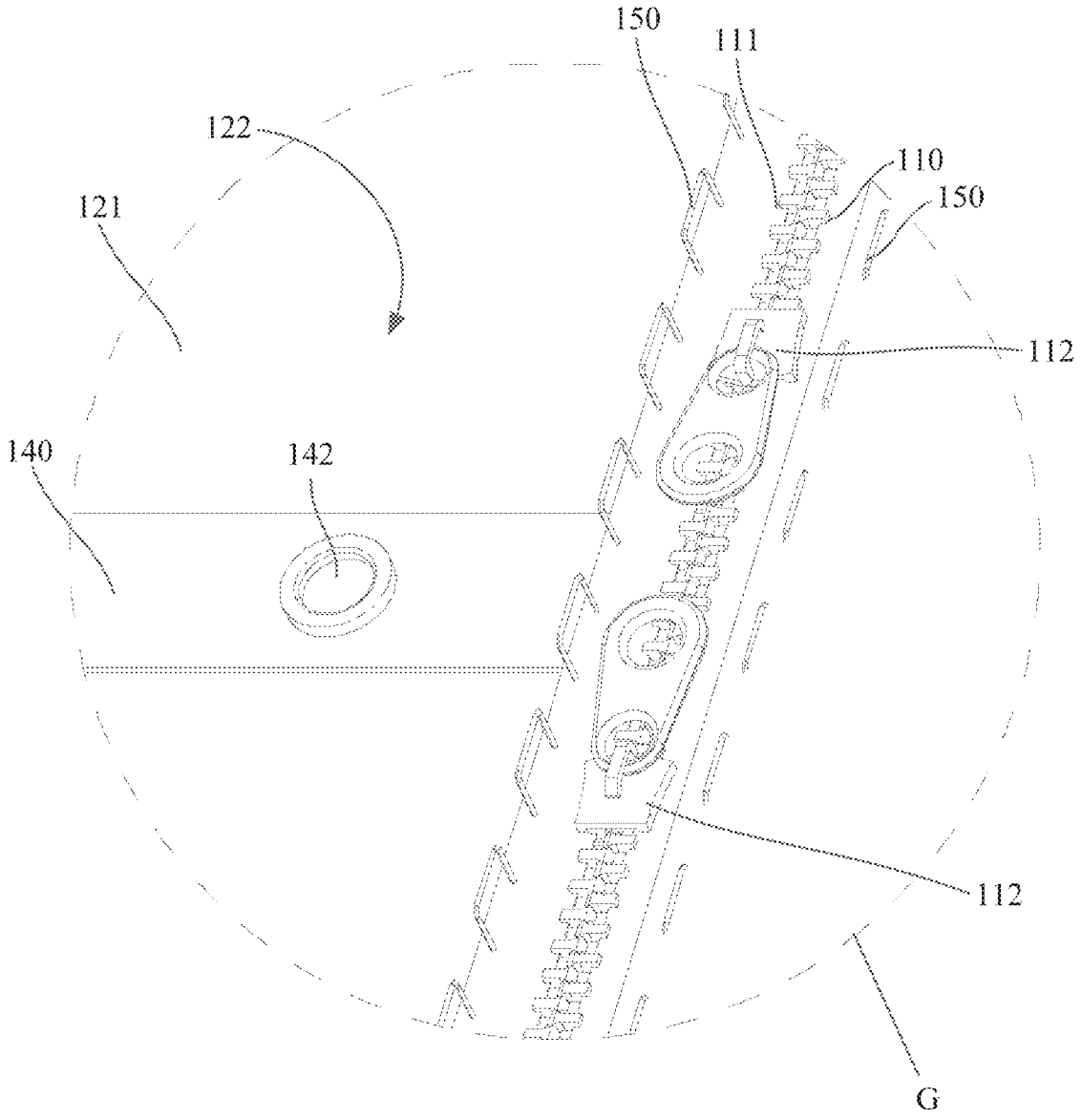
FIG. 4 is a partial enlarged view of portion G circumscribed in FIG. 2.

In the embodiments, specifically referring to FIGS. 3 and 4, by arranging the upper zipper chain 111, the lower zipper chain 110, the lower flange 123, and the lower accommodation zone 122 side by side, compared to a conventional design where the zipper 100 is set at an angle to the upper and lower cover pieces 124, 121, because the zipper 100 does not face towards the duvet insert, the duvet insert is less likely to get caught between the zipper teeth, thereby reducing zipper jamming. In addition, because the upper zipper chain 111, the lower zipper chain 110, the lower flange 123, and the lower accommodation zone 122 are side-by-side in the same direction, they won't get caught between the zipper teeth due to the collapse of the upper or lower cover pieces, thereby further reducing zipper jamming. Since the duvet insert, the upper cover piece 124, and the lower cover piece 121 are less likely to get caught in the zipper 100, scratching of these parts may be prevented when pulling the slider 112, and the service life of the duvet insert, the duvet cover 1, and the zipper 100 is thereby improved.

Furthermore, the zipper 100 includes at least two lower zipper chains 110 arranged at an angle to each other, at least two upper zipper chains 111 arranged at an angle to each other, a lower transition portion 116, and an upper transition portion 113. The lower transition portion 116 connects adjacent two lower zipper chains 110 of the at least two lower zipper chains 110. The upper transition portion 113 connects adjacent two upper zipper chains 111 of the at least two upper zipper chains 111. Teeth of the upper transition portion 113 and the lower transition portion 116 face each other, and a side-by-side direction of the upper transition portion 113 and the lower transition portion 116 is set at an angle to the lower flange 123.

Figure 6:
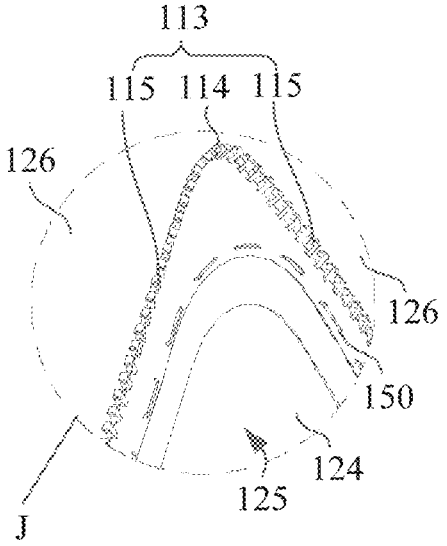
FIG. 6 is a partial enlarged view of portion J circumscribed in FIG. 5.
Figure 8:
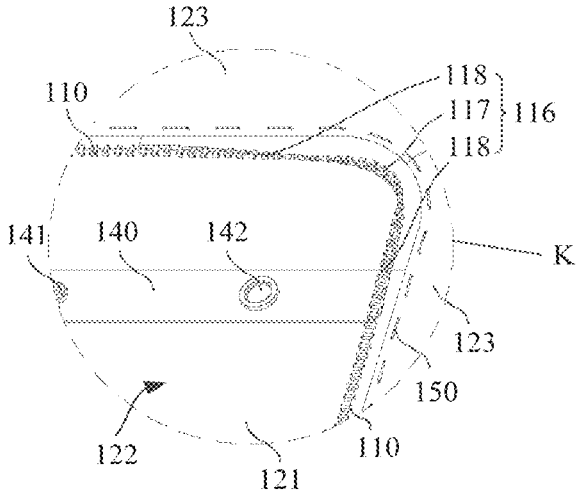
FIG. 8 is a partial enlarged view of portion K circumscribed in FIG. 7.

In the embodiments, referring to FIGS. 3, 6, and 8, the zipper 100 includes at least two lower zipper chains 110 set at an angle, at least two upper zipper chains 111 set at an angle, a lower transition portion 116, and an upper transition portion 113. That is, in the aforementioned embodiments, one lower zipper chain 110 is provided on each of two adjacent sides of the quadrilateral lower cover piece 121. The lower transition portion 116 is arranged between the two lower zipper chains 110 to connect the two lower zipper chains 110. Similarly; one upper zipper chain 111 is provided on each of two adjacent sides of the quadrilateral upper cover piece 124. The upper transition portion 113 is arranged between the two upper zipper chains 111 to connect the two upper zipper chains 111. It should be noted that when the lower transition portion 116 connects two adjacent lower zipper chains 110, and the upper transition portion 113 connects two adjacent upper zipper chains 111, and when the upper cover piece 124 covers the lower cover piece 121, the teeth of the upper and lower transition portions 113, 116 face each other, making them side-by-side. The side-by-side direction of the upper and lower transition portions 113, 116 is set at an angle to the lower flange 123.

Furthermore, the upper transition portion 113 includes an upper corner segment 114 and two upper transition segments 115. The two upper transition segments 115 smoothly connect two ends of the upper corner segment 114 to the two adjacent upper zipper chains 111, respectively. The lower transition portion 116 includes a lower corner segment 117 and two lower transition segments 118. The two lower transition segments 118 smoothly connect two ends of the lower corner segment 117 to the two adjacent lower zipper chains 110, respectively. The lower corner segment 117 and the upper corner segment 114 are aligned in a covering direction of the lower and upper cover pieces 121, 124.

In the embodiments, the upper and lower transition portions 113, 116 are further described. The upper transition portion 113 includes an upper corner segment 114 and two upper transition segments 115 for smoothly connecting the ends of the upper corner segment 114 to the adjacent upper zipper chains 111. In some embodiments, referring to the above, the upper corner segment 114 is a part on the diagonal of the upper cover piece 124, and the two upper transition segments 115 are parts on either side of the upper corner segment 114. Similarly, the lower transition portion 116 includes a lower corner segment 117 and two lower transition segments 118 for smoothly connecting the ends of the lower corner segment 117 to the adjacent lower zipper chains 110. In some embodiments, the lower corner segment 117 is a part on the diagonal of the lower cover piece 121, and the two lower transition segments 118 are the parts on either side of the lower corner segment 117. Additionally, when the upper cover piece 124 covers the lower cover piece 121, the lower and upper corner segments 117, 114 are aligned in the covering direction. In some embodiments, when aligned, the lower corner segment 117 are perpendicular to the lower flange 123. Furthermore, it should be noted that the term "smoothly connect" as used in the preceding description, where the two upper transition segments 115 smoothly connect the two ends of the upper corner segment 114 and the two adjacent upper zipper chains 111, respectively; means that the closer the two upper transition segments 115 are to the upper zipper chains 111, the smaller the angle between the two upper transition segments 115 and the upper flange 126 becomes, that is, they approach the side-by-side direction of the upper zipper chain 111, the lower zipper chain 110, the lower flange 123, and the lower accommodation zone 122; the closer the two upper transition segments 115 are to the upper corner segment 114, the larger the angle between the two upper transition segments 115 and the upper flange 126 becomes, that is, they deviate from the side-by-side direction of the upper zipper chain 111, the lower zipper chain 110, the lower flange 123, and the lower accommodation zone 122, or they approach being perpendicular to the lower flange 123. Similarly, the term "smoothly connect" as used in the preceding description, where the two lower transition segments 118 smoothly connect the two ends of the lower corner segment 117 and the two adjacent lower zipper chains 110, respectively, means that the closer the two lower transition segments 118 are to the lower zipper chains 110, the smaller the angle between the two lower transition segments 118 and the lower flange 123 becomes, that is, they approach the side-by-side direction of the upper zipper chain 111, the lower zipper chain 110, the lower flange 123, and the lower accommodation zone 122; the closer the two lower transition segments 118 are to the lower corner segment 117, the larger the angle between the two lower transition segments 118 and the lower flange 123 becomes, that is, they deviate from the side-by-side direction of the upper zipper chain 111, the lower zipper chain 110, the lower flange 123, and the lower accommodation zone 122, or they approach being perpendicular to the lower flange 123.

In the embodiments, the upper transition portion 113 is arranged to connect two adjacent upper zipper chains 111, and the lower transition portion 116 is arranged to connect two adjacent lower zipper chains 110. Further, the side-by-side direction of the upper transition portion 113 and the lower transition portion 116 is set at an angle to the lower flange 123. As a comparison, for a conventional arrangement where the upper transition portion 113 and lower transition portion 116 are aligned side-by-side with the lower flange 123, because a certain angle exists between the two lower zipper chains 110 or between the two upper zipper chains 111, the zipper teeth experience some compression, which significantly reduces the pitch between adjacent teeth. Consequently, when the slider 112 is pulled from one lower zipper chain 110 or upper zipper chain 111 to another lower zipper chain 110 or upper zipper chain 111, the reduced tooth pitch at the corner extremely easily causes the zipper to jam. In the present disclosure, by using the lower transition portion 116 and upper transition portion 113 provided in the embodiments to connect the adjacent lower zipper chains 110 and upper zipper chains 111 respectively, and because the lower transition portion 116 and upper transition portion 113 are set at an angle to the lower flange 123, the tooth pitch of the lower transition portion 116 and upper transition portion 113 is almost equal to the tooth pitch of the lower zipper chains 110 and upper zipper chains 111. This makes it less likely for the slider 112 to jam at the corner, resulting in smoother operation when pulling the slider 112.

Furthermore, the duvet cover 1 may further include at least one tie strap 140. Each tie strap 140 is fixedly stitched at a connection between the lower flange 123 and the lower accommodation zone 122 and is located within the duvet insert accommodation cavity 130.

Furthermore, each lower corner segment 117 is arranged with a corresponding tie strap 140.

Figure 2:
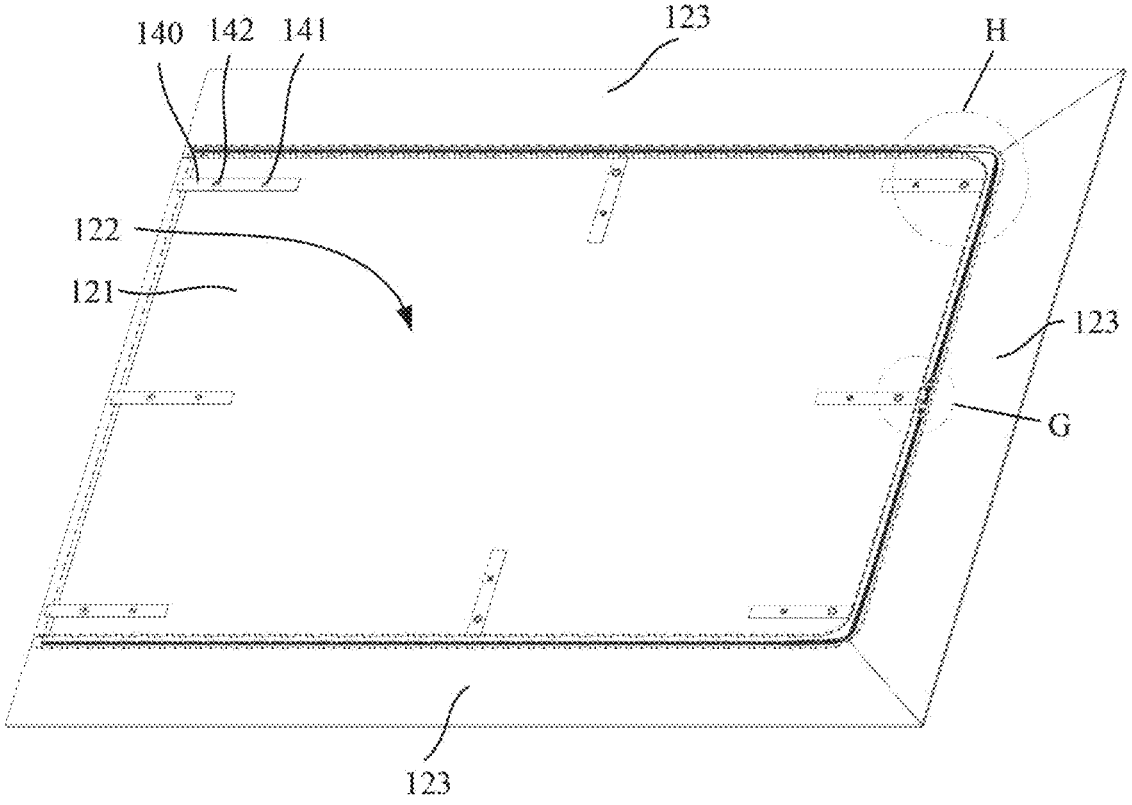
FIG. 2 is a structural schematic view of FIG. 1 excluding an upper cover piece.

In the embodiments, referring to FIGS. 2, 3, and 7, the tie straps 140 of the duvet cover 1 will be described in detail. One tie strap 140 is provided at each of the four corners of the quadrilateral duvet cover 1. i.e., at the locations of the lower transition portions 116, and/or, one tie strap 140 is provided on each of the four sides of the quadrilateral duvet cover 1. i.e., at the locations of the lower zipper chains 110. Each tie strap 140 is stitched at a connection between the lower flange 123 and the lower accommodation zone 122, and is positioned within the duvet insert accommodation cavity 130. Additionally, it should be noted that a surface of the tie strap 140 faces the covering direction of the upper cover piece 124 and the lower cover piece 121. Meanwhile, a male buckle 141 and a female buckle 142 are provided on two ends of the tie strap 140, both located on the surface of the tie strap 140 facing the upper cover piece 124. When the duvet insert is placed inside the duvet insert accommodation cavity 130, the tie straps 140 secure the corners and/or sides of the duvet insert, preventing it from sliding within the duvet insert accommodation cavity 130. In the embodiments, by providing the tie straps 140, compared to not having them, the corners and/or sides of the duvet insert are secured by the tie straps 140, thereby preventing sliding within the duvet insert accommodation cavity 130. Furthermore, by providing the male buckle 141 and female buckle 142 on the ends of the tie straps 140, the duvet insert can be easily fastened to the tie straps 140 through the engagement of the buckles.

Furthermore, a side edge of the lower cover piece 121 is stitched to a side edge of the upper cover piece 124. The other three side edges of the lower cover piece 121 are each arranged with a corresponding lower zipper chain 110. The other three side edges of the upper cover piece 124 are each provided with a corresponding upper zipper chain 111.

Figure 5:
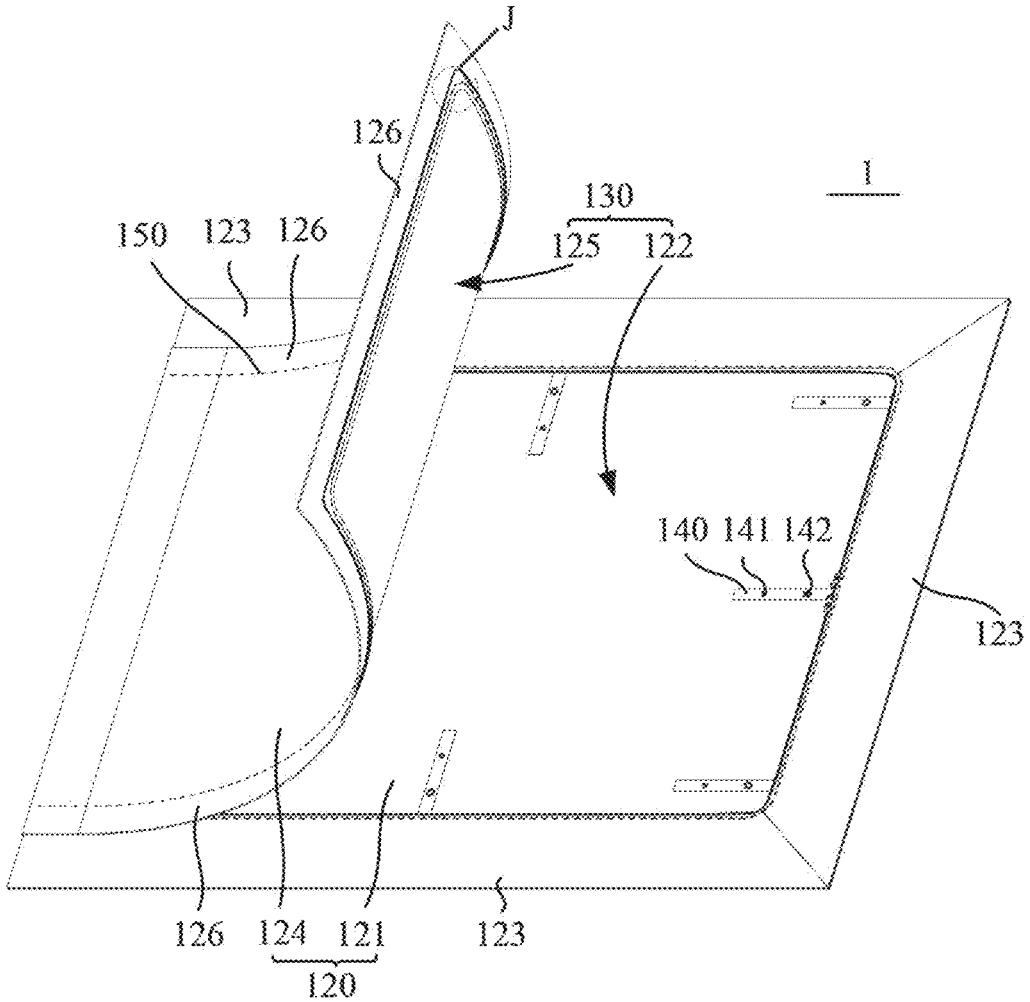
FIG. 5 is a structural schematic view of a duvet cover according to other embodiments of the present disclosure.
Figure 7:
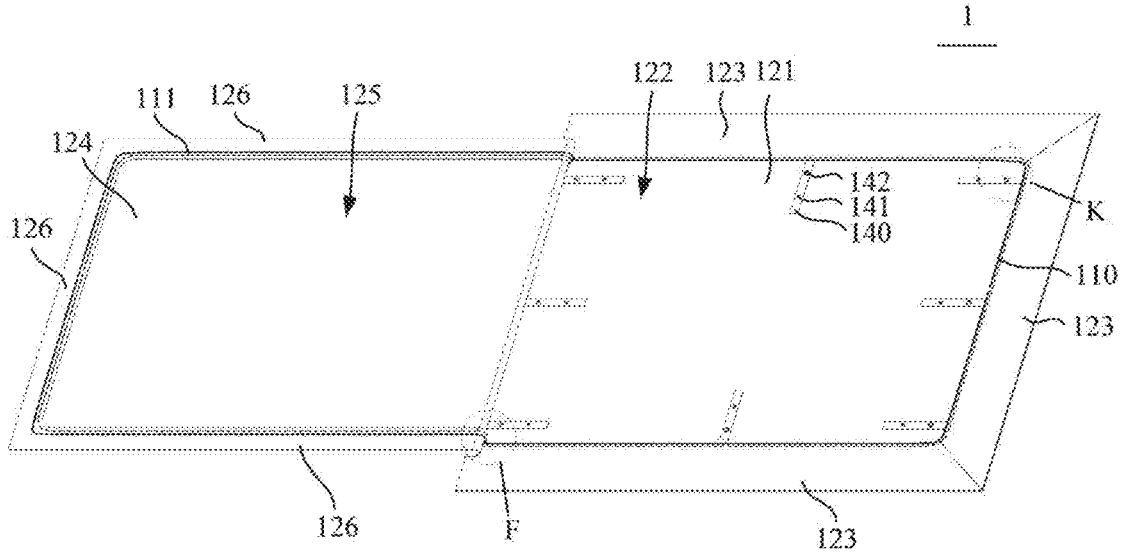
FIG. 7 is a structural schematic view of a duvet cover according to further other embodiments of the present disclosure.

The duvet cover 1 provided in the embodiments may be a quadrilateral duvet cover 1, as shown in FIGS. 5 and 7. A side edge of the quadrilateral duvet cover 1 is stitched shut. The other three side edges of the lower cover piece 121 are each provided with a corresponding lower zipper chain 110;

that is, lower zipper chains 110 are stitched onto a side edge opposite the stitched side edge and onto two adjacent side edges of the lower cover piece 121. The other three side edges of the upper cover piece 124 are each provided with a corresponding upper zipper chain 111; that is, upper zipper chains 111 are stitched onto a side edge opposite the stitched side edge and onto the two adjacent side edges of the upper cover piece 124. In the embodiments, by stitching one side of the quadrilateral duvet cover 1 and providing zippers on the other three sides, it is possible to place the duvet insert without completely separating the upper cover piece 124 and the lower cover piece 121, while also allowing the upper cover piece 124 and lower cover piece 121 to be opened to the greatest extent for easy insertion and removal of the duvet insert into/from the duvet insert accommodation cavity 130.

Furthermore, an edge of the lower cover piece 121 is folded back towards an edge of the lower accommodation zone 122, overlapping to form the lower flange 123. The lower zipper chain 110 is stitched between two opposing fabric surfaces of the lower flange 123.

In some embodiments, the edge of the lower cover piece 121 is folded back twice towards the edge of the lower accommodation zone 122 in the same direction, and the area of the second fold is larger than the area of the first fold. The overlapping edge forms the lower flange 123. The lower zipper chain 110 is stitched between the two opposing fabric surfaces of the lower flange 123. Furthermore, a stitching line 150 for stitching the lower zipper chain 110 to the lower flange 123 is located within the area of the first fold.

Furthermore, the edge of the upper cover piece 124 is folded back towards the edge of the upper accommodation zone 125, overlapping to form the upper flange 126. The upper zipper chain 111 is stitched onto a surface of the upper flange 126 that faces the lower cover piece 121.

In some embodiments, the edge of the upper cover piece 124 is folded back towards the edge of the upper accommodation zone 125, causing the edge of the upper cover piece 124 to overlap and form the upper flange 126. The edge of the upper cover piece 124 is hemmed to prevent fraying. The upper zipper chain 111 is stitched onto the surface of the upper flange 126 that faces the lower cover piece 121.

In the embodiments, by folding the lower cover piece 121 and upper cover piece 124 and then stitching the lower zipper chain 110 and upper zipper chain 111 onto the lower flange 123 and upper flange 126 respectively, the side-by-side arrangement of the upper zipper chain 111, the lower zipper chain 110, the lower flange 123, and the lower accommodation zone 122 is achieved. The beneficial effects of this side-by-side arrangement are as described above. Additionally, the lower flange 123 and upper the flange 126 can conceal the zipper 100, improving the overall aesthetics of the duvet cover 1. Moreover, because the upper flange 126 and the lower flange 123 are formed by folding, they have a more three-dimensional appearance, thereby further enhancing the aesthetics of the duvet cover 1.

Furthermore, a distance between the teeth of the lower zipper chain 110 and the stitching line 150 when the lower zipper chain 110 is stitched to the lower flange 123 is greater than a distance between the teeth of the upper zipper chain 111 and the stitching line 150 when the upper zipper chain 111 is stitched to the upper flange 126.

Figure 9:
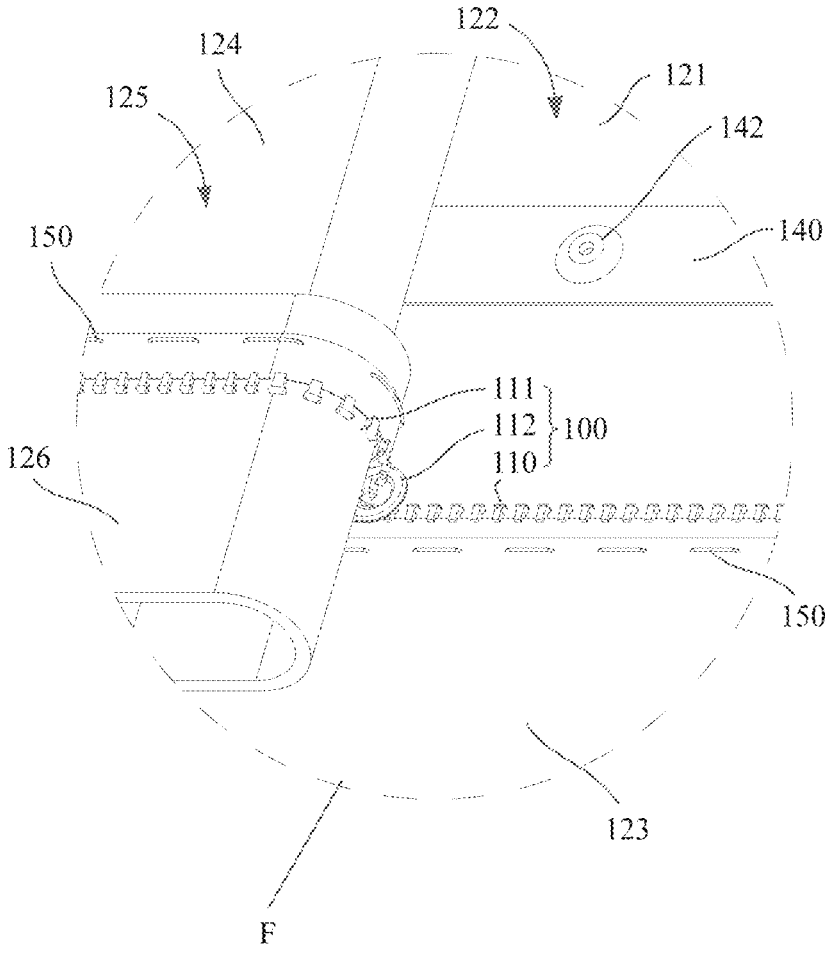
FIG. 9 is a partial enlarged view of portion F circumscribed in FIG. 7.

In the embodiments, referring to FIGS. 3, 4, and 9, when stitching the lower zipper chain 110 and upper zipper chain 111 to the lower flange 123 and the upper flange 126 respectively, the distance between the teeth of the lower zipper chain 110 and the stitching line 150 on the lower flange 123 is greater than the distance between the teeth of the upper zipper chain 111 and the stitching line 150 on the upper flange 126. In this implementation, by making the distance between the teeth of the lower zipper chain 110 and the stitching line 150 greater than that of the upper zipper chain 111, when pulling the slider 112, the larger gap between the teeth of the lower zipper chain 110 and the lower flange 123 makes it less likely for the lower flange 123 to get caught in the teeth and cause jamming. Furthermore, because the upper zipper chain 111 is stitched directly onto the surface of the upper flange 126 facing the lower cover piece 121, the tape of the upper zipper chain 111 lies between the upper cover piece 124 and the lower cover piece 121. This separates the teeth of the upper zipper chain 111 from the upper cover piece 124 by the tape, making it less likely for the upper cover piece 124 to get caught between the teeth. In addition, because the tape is relatively stiff, the tape itself is less likely to get caught between the teeth. Therefore, when pulling the slider 112, the slider 112 slides along the tape of the upper zipper chain 111. Consequently, it is also less likely for the lower cover piece 121 to get caught in the teeth and cause jamming during pulling. In summary, the above design may make pulling the slider 112 smoother. It should be noted that, for ease of description, the stitching lines 150 on the upper flange 126 and lower flange 123 are uniformly referred to as stitching line 150 in the embodiments. In practice, the stitching line 150 on the upper flange 126 is an upper stitching line, and the stitching line 150 on the lower flange 123 is a lower stitching line.

The present disclosure further proposes a duvet assembly. The duvet assembly includes a duvet insert and the duvet cover 1 described above. The specific structure of the duvet cover 1 refers to the aforementioned embodiments. Since the duvet assembly adopts all the technical solutions of the above embodiments, it possesses at least all the beneficial effects brought by the technical solutions of those embodiments, which will not be reiterated herein. The duvet cover 1 is the duvet cover 1 provided in the above embodiments, and the duvet insert is placed within the duvet insert accommodation cavity 130 of the duvet cover 1.

Finally, it should be noted that the above embodiments are merely intended to illustrate the technical solutions of the present disclosure, not to limit them. Although the present disclosure has been described in detail with reference to the foregoing embodiments, those skilled in the art should understand that they may still modify the technical solutions described in the foregoing embodiments, or make equivalent replacements to some of the technical features; and such modifications or replacements do not cause the essence of the corresponding technical solutions to deviate from the spirit and scope of the technical solutions of the embodiments of the present disclosure.

What is claimed is:

1. A duvet cover, comprising:

a zipper; wherein the zipper comprises at least one lower zipper chain and at least one upper zipper chain that cooperate with each other, and a slider that slidably cooperates with the at least one lower zipper chain and the at least one upper zipper chain; and a cover body, comprising a lower cover piece and an upper cover piece; wherein the lower cover piece comprises a lower accommodation zone located in a central part of the lower cover piece and a lower flange connected to an outer edge of the lower accommodation zone; the at least one lower zipper chain is stitched between the lower accommodation zone and the lower flange; the upper cover piece comprises an upper accommodation zone located in a central part of the upper cover piece and an upper flange connected to an edge of the upper accommodation zone; the at least one upper zipper chain is stitched between the upper accommodation zone and the upper flange; the upper accommodation zone and the lower accommodation zone are opposite to each other and enclose to define a duvet insert accommodation cavity;

wherein the at least one upper zipper chain is located on an inner side of the at least one lower zipper chain, with teeth of the at least one upper zipper chain and teeth of the at least one lower zipper chain facing each other; the at least one upper zipper chain, the at least one lower zipper chain, the lower flange, and the lower accommodation zone are arranged side by side;

wherein the at least one lower zipper chain is at least two lower zipper chains arranged at an angle to each other, and the at least one upper zipper chain is at least two upper zipper chains arranged at an angle to each other; the zipper further comprises a lower transition portion and an upper transition portion; the lower transition portion connects adjacent two lower zipper chains of the at least two lower zipper chains, and the upper transition portion connects adjacent two upper zipper chains of the at least two upper zipper chains;

teeth of the upper transition portion and the lower transition portion face each other, and a side-by-side direction of the upper transition portion and the lower transition portion is arranged at an angle to the lower flange;

wherein the upper transition portion comprises an upper corner segment and two upper transition segments; the two upper transition segments connect two ends of the upper corner segment to the adjacent two upper zipper chains, respectively; the lower transition portion comprises a lower corner segment and two lower transition segments; the two lower transition segments connect two ends of the lower corner segment to the adjacent two lower zipper chains, respectively; the lower corner segment and the upper corner segment are aligned in a covering direction of the lower cover piece and the upper cover piece; and wherein the duvet cover further comprises at least one tie strap; wherein each of the at least one tie strap is fixedly stitched at a connection between the lower flange and the lower accommodation zone and located within the duvet insert accommodation cavity.

2. The duvet cover according to claim 1, wherein each lower corner segment is arranged with a corresponding tie strap of the at least one tie strap.

3. The duvet cover according to claim 1, wherein a side edge of the lower cover piece is stitched to a side edge of the upper cover piece, other three side edges of the lower cover piece are each arranged with a corresponding lower zipper chain, and other three side edges of the upper cover piece are each arranged with a corresponding upper zipper chain.

4. The duvet cover according to claim 1, wherein an edge of the lower cover piece is folded back towards an edge of the lower accommodation zone to overlap and form the lower flange, and the lower zipper chain is stitched between two opposing fabric surfaces of the lower flange.

5. The duvet cover according to claim 4, wherein an edge of the upper cover piece is folded back towards an edge of the upper accommodation zone to overlap and form the upper flange, and the upper zipper chain is stitched onto a fabric surface of the upper flange facing the lower cover piece.

6. The duvet cover according to claim 5, wherein a distance between teeth of each of the at least one lower zipper chain and a stitching line when the lower zipper chain is stitched to the lower flange is greater than a distance between teeth of each of the at least one upper zipper chain and a stitching line when the upper zipper chain is stitched to the upper flange.

7. A duvet assembly, comprising a duvet insert and a duvet cover;

wherein the duvet cover comprises:

a zipper; wherein the zipper comprises at least one lower zipper chain and at least one upper zipper chain that cooperate with each other, and a slider that slidably cooperates with the at least one lower zipper chain and the at least one upper zipper chain; and a cover body, comprising a lower cover piece and an upper cover piece; wherein the lower cover piece comprises a lower accommodation zone located in a central part of the lower cover piece and a lower flange connected to an outer edge of the lower accommodation zone; the at least one lower zipper chain is stitched between the lower accommodation zone and the lower flange; the upper cover piece comprises an upper accommodation zone located in a central part of the upper cover piece and an upper flange connected to an edge of the upper accommodation zone; the at least one upper zipper chain is stitched between the upper accommodation zone and the upper flange; the upper accommodation zone and the lower accommodation zone are opposite to each other and enclose to define a duvet insert accommodation cavity;

wherein the at least one upper zipper chain is located on an inner side of the at least one lower zipper chain, with teeth of the at least one upper zipper chain and teeth of the at least one lower zipper chain facing each other; the at least one upper zipper chain, the at least one lower zipper chain, the lower flange, and the lower accommodation zone are arranged side by side;

wherein the duvet insert is placed within the duvet insert accommodation cavity of the duvet cover;

wherein the at least one lower zipper chain is at least two lower zipper chains arranged at an angle to each other, and the at least one upper zipper chain is at least two upper zipper chains arranged at an angle to each other; the zipper further comprises a lower transition portion and an upper transition portion; the lower transition portion connects adjacent two lower zipper chains of the at least two lower zipper chains, and the upper transition portion connects adjacent two upper zipper chains of the at least two upper zipper chains;

teeth of the upper transition portion and the lower transition portion face each other, and a side-by-side direction of the upper transition portion and the lower transition portion is arranged at an angle to the lower flange;

wherein the upper transition portion comprises an upper corner segment and two upper transition segments; the two upper transition segments connect two ends of the upper corner segment to the adjacent two upper zipper chains, respectively; the lower transition portion comprises a lower corner segment and two lower transition segments; the two lower transition segments connect two ends of the lower corner segment to the adjacent two lower zipper chains, respectively; the lower corner segment and the upper corner segment are aligned in a covering direction of the lower cover piece and the upper cover piece; and wherein the duvet cover further comprises at least one tie strap; wherein each of the at least one tie strap is fixedly stitched at a connection between the lower flange and the lower accommodation zone and located within the duvet insert accommodation cavity.

8. The duvet assembly according to claim 7, wherein each lower corner segment is arranged with a corresponding tie strap of the at least one tie strap.

9. The duvet assembly according to claim 7, wherein a side edge of the lower cover piece is stitched to a side edge of the upper cover piece, other three side edges of the lower cover piece are each arranged with a corresponding lower zipper chain, and other three side edges of the upper cover piece are each arranged with a corresponding upper zipper chain.

10. The duvet assembly according to claim 7, wherein an edge of the lower cover piece is folded back towards an edge of the lower accommodation zone to overlap and form the lower flange, and the lower zipper chain is stitched between two opposing fabric surfaces of the lower flange.

11. The duvet assembly according to claim 10, wherein an edge of the upper cover piece is folded back towards an edge of the upper accommodation zone to overlap and form the upper flange, and the upper zipper chain is stitched onto a fabric surface of the upper flange facing the lower cover piece.

12. The duvet assembly according to claim 11, wherein a distance between teeth of each of the at least one lower zipper chain and a stitching line when the lower zipper chain is stitched to the lower flange is greater than a distance between teeth of each of the at least one upper zipper chain and a stitching line when the upper zipper chain is stitched to the upper flange.

* * * * *